US005858485A

United States Patent [19]

Chou et al.

[11] Patent Number: 5,858,485

[45] Date of Patent: Jan. 12, 1999

[54] STRUCTURE AND PROCESS FOR PRODUCING ARTIFICIAL FRUITS AND VEGETABLES

[76] Inventors: John Y. Chou; Jack Y. Wang, both of 14038 Park Pl., Cerritos, Calif. 90701

[21] Appl. No.: 570,358

[22] Filed: Dec. 11, 1995

[51] Int. Cl.[6] ..... A41G 1/00

[52] U.S. Cl. ..... 428/21; 426/803

[58] Field of Search ..... 426/803; 428/21, 428/17; 156/61; 362/122

[56] References Cited

U.S. PATENT DOCUMENTS

| | | | |
|---|---|---|---|
| 836,887 | 11/1906 | Miller | 428/21 |
| 1,436,024 | 11/1922 | Emery | 428/21 |
| 2,779,058 | 1/1957 | Hyde | 428/21 X |
| 3,189,508 | 6/1965 | Burnbaum | 428/21 |
| 4,119,739 | 10/1978 | Barwick et al. | 426/575 X |
| 4,283,011 | 8/1981 | Spector | 428/21 X |
| 4,348,418 | 9/1982 | Smith et al. | 426/802 X |
| 4,795,033 | 1/1989 | Duffy | 428/21 X |
| 5,084,296 | 1/1992 | Lugay et al. | 426/573 |
| 5,270,064 | 12/1993 | Shultz | 426/803 X |
| 5,526,243 | 6/1996 | Masters | 362/122 |

*Primary Examiner*—Henry F. Epstein
*Attorney, Agent, or Firm*—Albert O. Cota

[57] ABSTRACT

A structure and process for producing artificial fruits and vegetables (10). The structure consists of an inner assembly (12) that includes an upward extending stem (30) attached to a weighted core (14). The inner assembly is contained within a semi-rigid enclosure (48) that is subsequently covered with a resilient material (62) that is colored and textured to simulate a particular species of a fruit or vegetable. The process utilizes a mold (66) having a spherical cavity (96) into which is centrally placed the weighted core (14) with the stem (30) projecting through the mold's upward end (86). The mold (66) also has a fill port (92) into which is inserted a specified quantity of polystyrene beads. The beads expand when the mold is heated, to fill the cavity (96) and form the semi-rigid enclosure (48). The enclosure (48) is then covered with the resilient material (62) and the enclosure with the resilient material is placed in a hot-pressure mold that adds a texture. After the textured structure is removed from the mold, a color is added that simulates the color of the specific artificial fruit or vegetable.

1 Claim, 4 Drawing Sheets

STRUCTURE AND PROCESS FOR PRODUCING ARTIFICIAL FRUITS AND VEGETABLES

TECHNICAL FIELD

The invention pertains to the general field of artificial fruits and vegetables and more particularly to artificial fruits and vegetables that have the feel, texture and overall appearance of real fruits and vegetables.

BACKGROUND ART

The use of artificial fruit and vegetables has become extremely predominant, as the ability to present such items to a consumer has improved with current technology. Many restaurants and other food service companies offer a preview of their menu items by use of artificial samplers which highlight some of the specialities available. These samplers are not meant to be consumed, but rather, are used to give a diner or customer an idea of the appearance of a particular dish. This assists someone who may be curious about a certain item prior to ordering or purchasing In any presentation medium that requires the use of high-intensity light-sources, such as television commercials, the use of real, living or non-living fruits and vegetables has been shown to be ineffective.

Also, any use that requires more than a minimal duration of time has proven to present significant problems as well. The reason for these, and other problems, is that real fruit and vegetables, especially after having been removed from their respective growing environment, wither and die very quickly. When exposed to various elements, such as a high-intensity light source, as mentioned above, the withering and dying process is considerably accelerated.

An alternative to using real fruits and vegetables is to use artificial fruits and vegetables. The most common and current method of manufacturing artificial fruits and vegetables utilizes shaped foam. The foam is first formed to give the appearance of whichever fruit or vegetable is desired. This piece is then cut into two pieces which are then filled to the respective weight of the individual fruit or vegetable. Usually sand, plaster or cement is used as a filler. Once filled, the two pieces are re-attached by use of an adhesive. There are several problems that are inherent to this method of manufacture. First and foremost is the fact that the several steps involved are very time consuming and require certain degrees of precision to guarantee an authentic looking fruit or vegetable. The materials are not expensive, but when compared with the inventive method of manufacture, and when considered along with the price of labor, the cost is decidedly higher.

Also, with other current methods of manufacture, many of the artificial fruits and vegetables develop mildew during the manufacturing process. The mildew is un-detectable during the process and subsequently remains on the finished product. The inventive process remedies this problem by allowing the detection of mildew prior to the product being completed. The mildew can be eradicated and will therefore present no further problem to the purchaser.

The stems on current artificial fruits and vegetables often utilize a hand-wrapping process of manufacture. Paper, the primary wrapping material, is wrapped around a centrally located piece of wire, which functions as a support and stabilizer. Unfortunately, there are problems such as unwrapping and unrealism that are associated with this method of manufacture. The inventive process hand wrapped stems, does not suffer from the non-inherent problems of the current designs.

A search of the prior art which included U.S. patents and industry publications did not disclose any art that read on the claims of the instant invention. However, the following two patents are considered are related:

| PATENT NO. | INVENTOR | ISSUED |
|---|---|---|
| 5,084,296 | Lugay, et al | 28 January 1992 |
| 4,119,739 | Barwick, et al | 10 October 1978 |

The U.S. Pat. No. 5,084,296 Lugay, et al patent a simulated fruit piece suitable for combination with a dry food product. The fruit piece maintains its softness and the food product maintains its crispness after various storage conditions. The fruit consists of fruit solids, a fruit concentrate, a thickening agent, edible food grade acid, sweeteners, coloring and glycerol. A process for preparing the fruit piece is also disclosed wherein a solid phase comprising a fruit solids is combined with a hot liquid phase and the mixture extruded into fruit ropes or strands and cut into the desired shape or form.

The U.S. Pat. No. 4,119,739 Barwick, et al patent discloses a process for preparing simulated soft fruit such as blackcurrants, blueberries and bilberries in which a relatively tough skin surrounds a liquid or at least a substantially liquid interior.

DISCLOSURE OF THE INVENTION

The disclosed invention is designed to produce artificial fruit and vegetable structures that have the appearance, weight and feel of the particular fruit or vegetable that is being simulated. The invention also has a provision for allowing the structure to have a smell like that of the simulated fruit or vegetable. In its most basic design, the artificial fruit and vegetable structure consists of:

a) a weighted core having an upper surface and a lower surface, b) a semi-rigid enclosure having an outer surface and an inner cavity. The cavity is dimensioned to receive and compressively enclose the weighted core, and c) a resilient material that covers the semi-rigid enclosure. The material simulates the shape, color and texture of the artificial fruit or vegetable being simulated.

The weighted core is an element of an inner assembly that also includes a semi-rigid stem having a lower end that is attached to the upper surface of the weighted core.

To produce a fruit or vegetable structure, a process is followed that utilizes a mold having a spherical cavity, a stem bore that extends vertically from the cavity through the upper end of the mold and a mold fill port that also extends from the cavity to the upper end of the mold. To commence the production process, the inner assembly is centrally located and suspended within the spherical cavity with the stem projecting through the stem bore of the mold. The mold is then partially filled with a quantity of of thermoplastic or thermosetting foam beads that are inserted through the mold fill port. The mold is placed into a steam chamber, for approximately 10–15 minutes, to allow the foam beads to expand and fill the remaining cavity surrounding the weighted core.

The resulting structure which consists of the semi-rigid enclosure with the encased weighted core and the stem projecting outward from the enclosure is removed from the mold. The structure is placed in a receptacle which contains a resilient material. The resulting structure, with a coating of the resilient material, is then placed in a hot-pressure mold that has a textured cavity. The mold impresses the resilient material with a textured surface which is then painted with the color or colors of the fruit or vegetable being simulated.

In view of the above disclosure, it is the primary object of the invention to produce an artificial fruit or vegetable that accurately simulates a real fruit or vegetable.

In addition to the primary object, it is also an object of the invention to produce an artificial fruit or vegetable that:

- is easily manufactured from readily available materials,
- may be used several times, for varying purposes, thus increasing the useful life and cost effectiveness of the product,
- may be weighted, colored and scented to give the appearance of actual, living fruits and vegetables,
- may be used singularly or in multiple "bunches" depending on the effect desired,
- are able to withstand exposure to a variety of elements that would otherwise destroy living fruits and vegetables,
- have an indefinite life-expectancy with an appearance that will not change over time, and
- eliminates or reduces incidents of mildew that normally occur during the manufacturing process of artificial fruits and vegetables.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
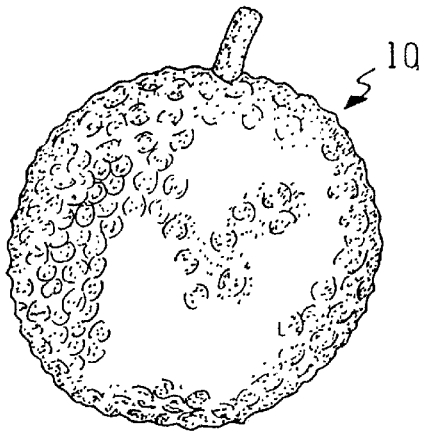
FIG. 1 is a perspective view of an artificial fruit, namely an orange as produced by the disclosed process.

The best mode for carrying out the invention is presented in two embodiments that are each designed to produce an artificial fruit or vegetable that simulates the appearance and feel of an actual fruit or vegetable.

The first embodiment of the structure and process for producing artificial fruits and vegetables 10 is presented in FIGS. 1–18 and is comprised of three major structural elements: an inner assembly 12, consisting of a weighted core 14 and a semi-rigid stem 30, a semi-rigid enclosure 48, and an outer material 60.

Figure 2:
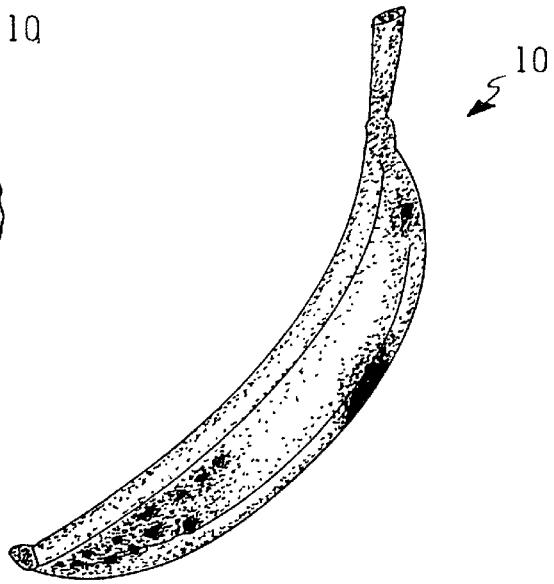
FIG. 2 is a perspective view of an artificial fruit, namely a banana as produced by the disclosed process.
Figure 3:
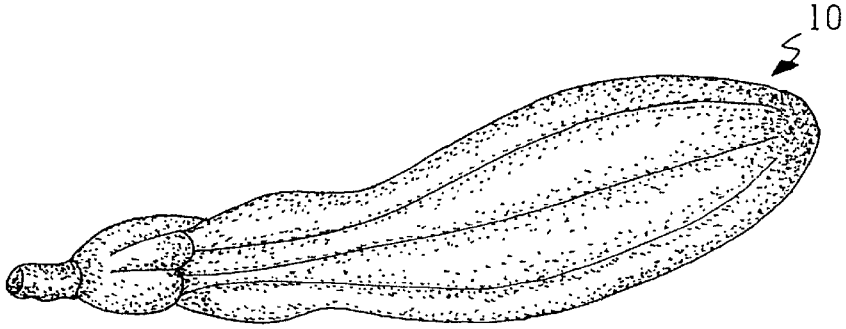
FIG. 3 is a perspective view of an artificial vegetable, namely a zucchini as produced by the disclosed process.

The overall appearance of a typical artificial fruit is shown in FIGS. 1 and 2 where an orange and a banana are depicted respectively and a typical vegetable, such as a zucchini, is shown in FIG. 3.

Figure 4:
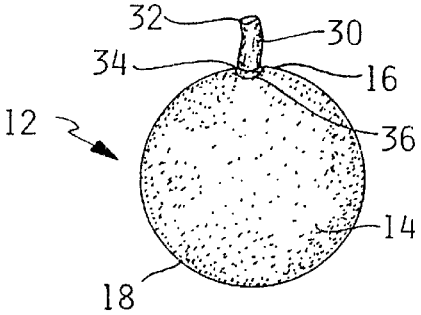
FIG. 4 is an elevational view of an inner assembly showing a stem attached to a weighted core.
Figure 5:
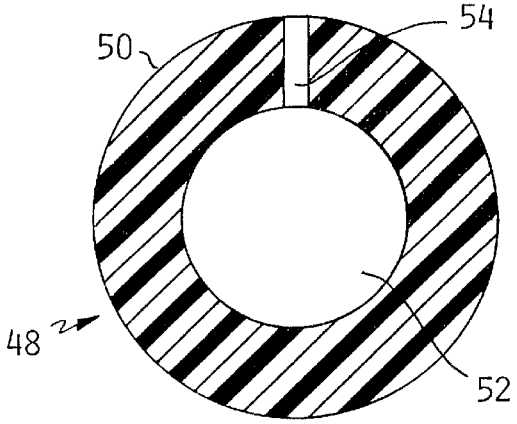
FIG. 5 is an elevational-sectional view of a semi-rigid enclosure.
Figure 7:
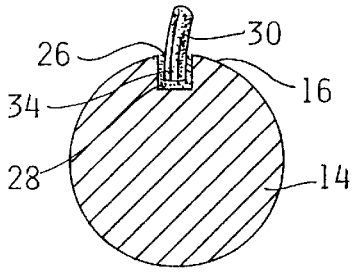
FIG. 7 is an elevational-sectional view of a weighted core constructed of a metal compound and of stem attached by means of a cavity and adhesive.
Figure 8:
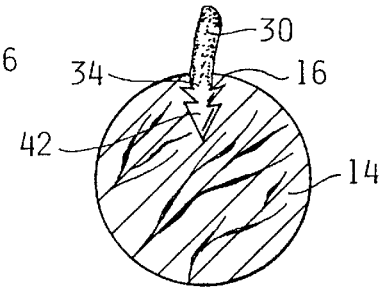
FIG. 8 is an elevational-sectional view of a weighted core constructed of a wood and a stem attached by means of arrow barbs.

The elements of the inner assembly 12 are shown separated in FIGS. 4 and 5. The weighted core 14 as shown in FIG. 4, has an upper surface 16 and a lower surface 18. The core can be constructed of any weight bearing material such as a clay compound as shown in FIG. 6, a metal as shown in FIG. 7 or a wood as shown in FIG. 8.

Figure 6:
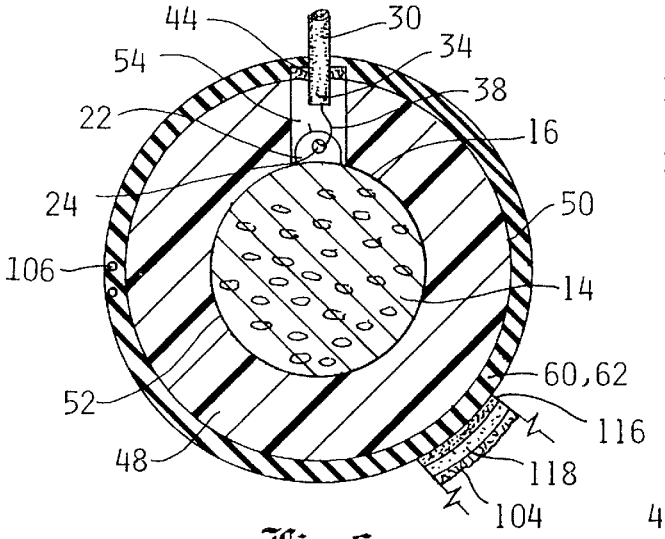
FIG. 6 is an elevational-sectional view of a typical fruit structure showing the relative locations of the weighted core that is constructed of a clay compound, a stem, the semi-rigid enclosure and the outer material.

The semi-rigid stem 30 as shown in FIGS. 4 and 6, has an upper end 32 and a lower end 34. The lower end 34 is attached by an attachment means 36 to the center upper surface 16 of the weighted core 14. The stem 30 is preferably made of a plastic material. However, other materials such as pulp or wood may also be utilized.

The method for attaching the stem 30 to the core 14 is disclosed in three stem attachment means 36. In the first and preferred means as shown in FIG. 6, the weighted core 14 has attached to its upper surface 16 an upward extending protrusion 22 that includes a hook bore 24 therethrough. The stem 30 used with this embodiment, as also shown in FIG. 6, has attached to its lower end 34 a hook 38 that is sized to fit into the hook bore 24. The second stem attachment means 36 as shown in FIG. 7, consists of having a stem cavity 26 centrally located on the upper surface 16 of the weighted core 14. The cavity is dimensioned to receive a quantity of an adhesive 28 and the lower end 34 the stem 36. The third stem attachment means 36 as shown in FIG. 8, utilizes a stem 30 having a lower end 34 configured with downward-extending arrow barbs 42. When the barbs 42 are forced into the weighted core 14, the stem 30 is permanently attached.

The semi-rigid enclosure 48 is shown as a separate element in FIG. 5 and with the core 14 inserted FIG. 6. The enclosure has an outer surface 50 and an inner cavity 52, with the outer surface 50 having therethrough a centrally located stem bore 54. The enclosure 48 is formed within a mold 66, of a material 56 that expands by an expansion means as described infra.

The expanded material 56 compressively encloses the inner assembly 12 with the weighted core 14 substantially centered within the cavity 52 and with the stem 30 projecting upward through the stem bore 54 and held therein by a stem stop 44 as shown in FIG. 6. The expansion material 56 may consist of a thermoplastic or a thermosetting foam 80. The thermoplastic foam 80, which is preferred, consists of polystyrene beads. However, other expanding foam materials such as polyethylene, styrene butadiene, polyvinyl chloride, acrylic or silicone may also be utilized.

After the semi-rigid enclosure 48 is formed and removed from the mold 66, the outer surface 50 and the area around the stem stop 44 is covered with a layer of an outer material 60 as shown in FIG. 6. The material 60 preferably consists of a resilient material 62 that simulates the shape, color and texture of the artificial fruit or vegetable 10. The resilient material 62 is comprised of a visco-elastic composition that includes the following:

90–95% of a softening agent which preferably consists of a co-polymer of acrylic styrene and butadiene, sold under the trademark P-BBB®

0.5–2% of smoothing leveling agent, which preferably consists of a polyurethane type thickener, sold under the trademark REMO 4000®

0–5% of an adhesive, which preferably consists a hydrocarbon resin sold under the trademark AP-60®, and 0.5–2% of a tack removing agent, which preferably consists of a silica sold under the trademark P-244®.

The actual percentages used on the outer material 60 is dependent upon the specific appearance and feel that is required for the specific fruit or vegetable being produced. For example, the outer material used for an orange would differ from that of an apple. To further enhance the realism of the fruits and vegetables, a fragrance in the form of a fragrance micro-module 106 may be added to the composition of the resilient material 62 as shown in FIG. 6. Also, if a fruit such as a peach is being produced, an additional coating of a flocking material 104 may be added to the resilient coating.

The mold 66 used to produce the fruits and vegetables consists of a first mold section 68 and a second mold section 82.

Figure 9:
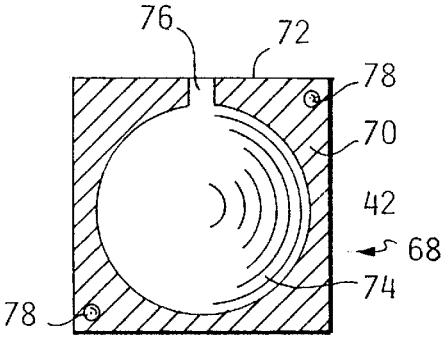
FIG. 9 is an elevational-sectional view of a first mold section.

The first mold section 68 as shown in FIG. 9, has an inward planar surface 70 with an upward end 72 and an inward-projecting first hemispherical cavity 74. The cavity 74 further includes a first-half of a stem bore 76 that extends vertically from the cavity 74 through the upward end 72. Along the planar surface 70 there is located at least two mold attachment-alignment pins 78.

Figure 10:
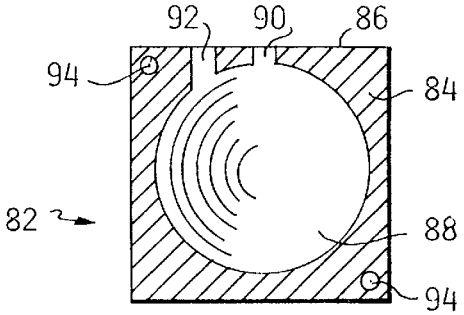
FIG. 10 is an elevational-sectional view of a second mold section.
Figure 11:
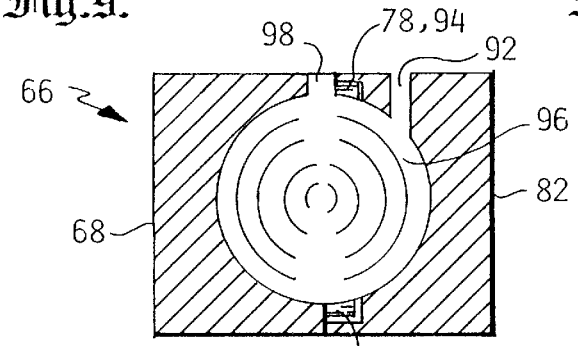
FIG. 11 is an elevational-sectional view of a full mold.

The second mold section 82 as shown in FIG. 10, has an inward planar surface 84 with an upward end 86 and an inward-projecting second hemispherical cavity 88. The cavity 88 further includes a second-half of a stem bore 90 that extends vertically from the cavity 88 through the upward end 86, and a mold fill port 92 that extends from the upward end 86 into the cavity 88. Along the planar surface 84 there is located at least two mold attachment-alignment pin bores 94 that are aligned with the pins 78 on the first mold section 68. When the first and second mold sections 68,82 as shown in FIG. 11, interface, an inner spherical cavity 96 and a stem 98 bore are formed.

Figure 12:
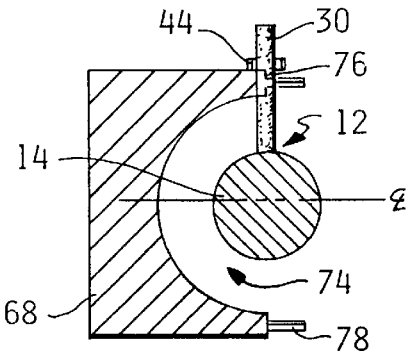
FIG. 12 is a side-elevational view of the first mold section having inserted and attached the inner assembly.
Figure 13:
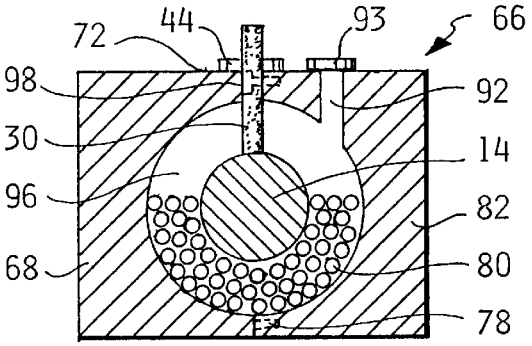
FIG. 13 is a side-elevational view of a full mold showing the location of the inner assembly and the mold's spherical cavity partially filled with thermoplastic foam beads.
Figure 14:
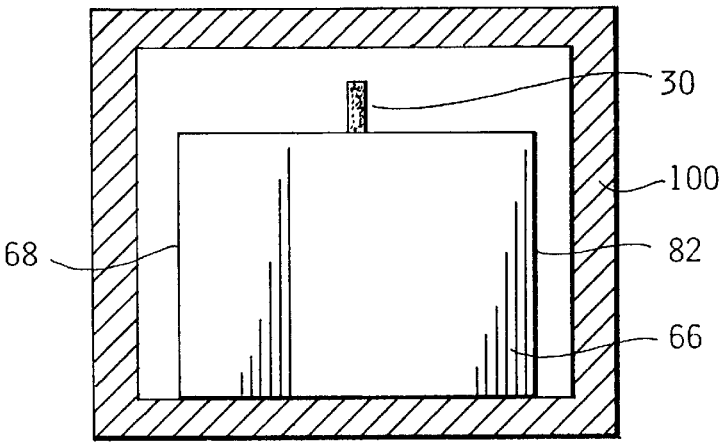
FIG. 14 is an elevational-sectional view of a steam chamber having inside the mold the inner assembly and with the mold partially filled with the thermoplastic foam beads.
Figure 15:
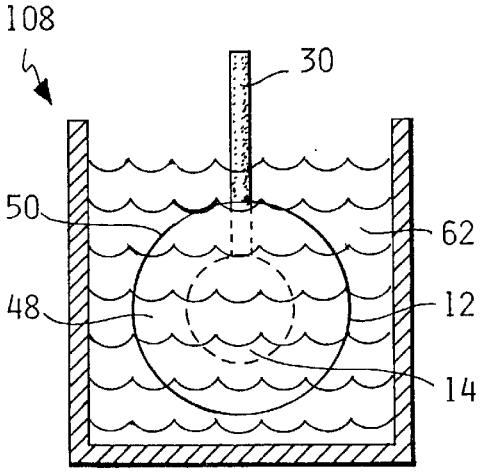
FIG. 15 is an elevational-sectional view of a receptacle filled with a resilient material into which is emersed an inner assembly.
Figure 16:
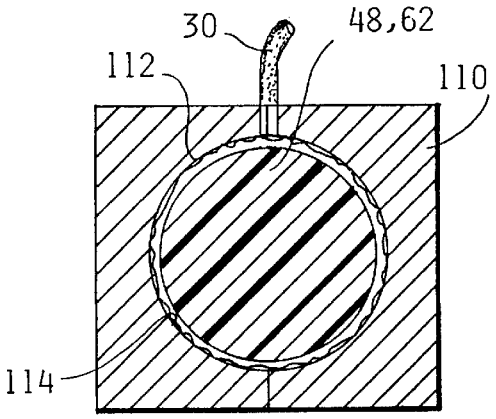
FIG. 16 is an elevational-sectional view of a hot-pressure mold that applies a texture to the semi-rigid enclosure.

The process for producing the first embodiment of the artificial fruit and vegetable structure 10 in the mold 66 is comprised of the following steps with reference to FIGS. 6–8:

(1) construct an inner assembly 12 as shown in FIGS. 6–8 consisting of a weighted core 14 having an upper surface 16 to which is attached a semi-rigid stem 30 having a substantially centered and removable stem stop 44 attached thereto as shown in FIG. 6, (2) insert the inner assembly 12 as shown in FIG. 12 into the first mold section 68 with the weighted core 14 substantially centered within the first hemispherical cavity 74 with the stem stop 44 resting on the upward end of the first-half stem bore 76, (3) place the second mold section 82 over the first mold section 68 as shown in FIG. 13 to form the mold 66. Observe that the stem 30 is projecting through the upward end 72 of tie stem bore 98 on the mold, (4) place the mold 66 in an upright position and insert a specific quantity of a thermoplastic foam beads 80 into the cavity 96 through the fill port 92 as also shown in FIG. 13, (5) cap the fill port 92 with a capping means 93, (6) place the mold 66 into a steam chamber 100 as shown in FIG. 14 for a specified period of time, which typically consists of 10 to 15 minutes, to cause the thermoplastic foam beads 80 to expand and fill the mold cavity 96, (7) remove the first and second sections 68,82 of the mold 66 to expose a semi-rigid enclosure 48 as shown in FIG. 6, having the stem 30 projecting upward from the upper outer surface 50, of the enclosure 48, (8) immerse the semi-rigid enclosure 48 into a receptacle 108 as shown in FIG. 15 containing a quantity of a resilient material 62 that completely covers the outer surface 50 of the enclosure 48 and the area where the stem 30 projects through the enclosure 48, (9) allow the resilient material 62 to dry,

(10) place the semi-rigid enclosure covered with the resilient material 62, into a hot-pressure mold 110 as shown in FIG. 16, having a cavity 112 with a textured surface 114 simulating the texture of a particular fruit or vegetable. The hot-pressure mold applies the texture to the resilient material 62,

(11) add a base color 116 to the textured surface of the resilient material, as shown in FIGS. 1–3, and

(12) add a final color 118 as also shown in FIGS. 1–3 to the textured surface that simulates the color of the artificial fruit or vegetable.

Figure 17:
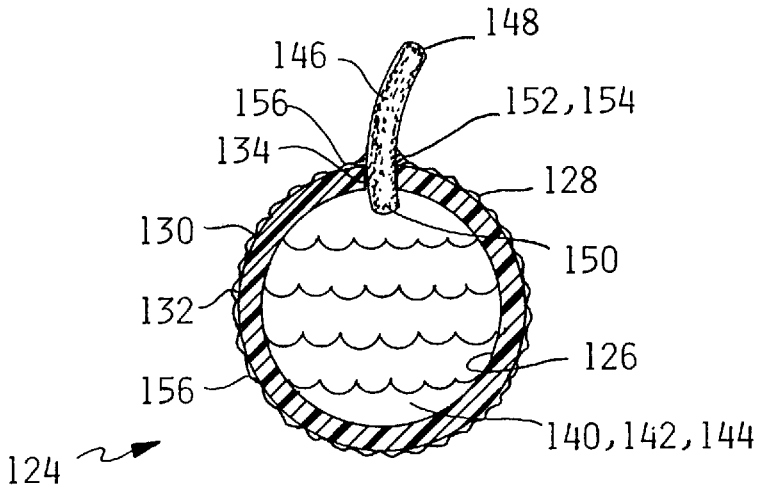
FIG. 17 is an elevational-sectional view of a second embodiment semi-rigid enclosure having a weighted core that consists of a fluid.
Figure 18:
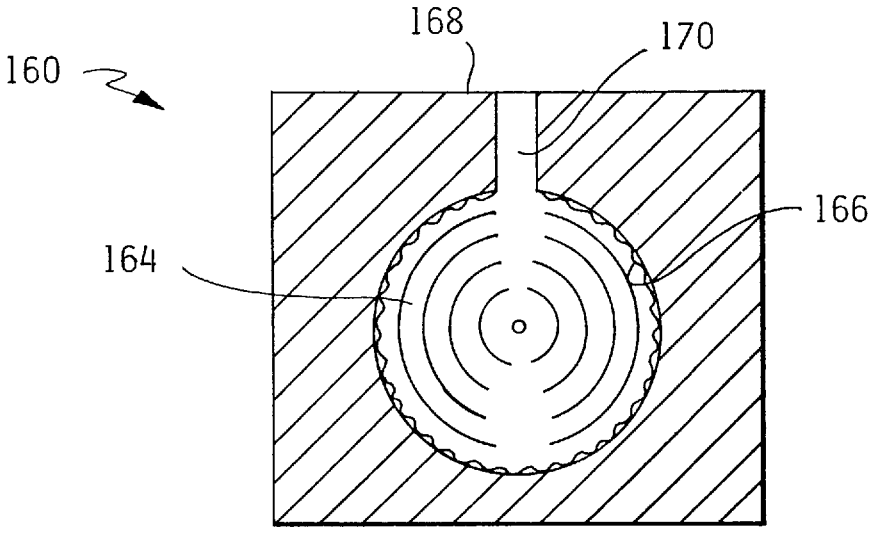
FIG. 18 is a side-elevational view of a mold that is used with the second embodiment to produce a semi-rigid enclosure with a textured outer surface.

The second embodiment of the structure and process for producing artificial fruits and vegetables 10 is presented in FIGS. 17 and 18 and is comprised of three major structural elements: a semi-rigid enclosure 124, a weighted core 140 and a semi-rigid stem 146.

The overall appearance of a typical artificial fruit or vegetable produced by the second embodiment is similar to those produced by the first embodiment as are shown in FIGS. 1–3.

The semi-rigid enclosure 124 as shown in FIG. 17 is constructed in a blow mold 160 as shown in FIG. 18 of a thermoplstic or thermosetting foam. The enclosure 124 has an inner cavity 126, an upper end 128 and an outer surface 130. The outer surface 130 has a texture 132 that simulates the skin texture of a particular species of the fruit or vegetable being produced. Extending downward from the upper end 128 of the enclosure into the cavity 126 is a stem/fill bore 134.

The weighted core 140 used in the second embodiment as shown in FIG. 17, is comprised of a fluid 142 that is inserted into the inner cavity 126 through the stem/fill bore 134. The fluid preferably consists of a jelled substance 144. However, any liquid or viscous solution can be utilized.

The semi-rigid stem 146, as also shown in FIG. 17, includes an upper end 148 and a lower end 150. The lower end 150 is sized to fit over and seal the stem/fill port 134 by a sealing means 152, after the cavity 126 has been filled with the fluid 142. The preferred sealing means comprises an adhesive 154. After the stem 146 is sealed, a color 156 is applied to the textured outer surface 130 of the enclosure 124 and the stem 146. The color 156 is selected to simulate the color of the particular species of fruit or vegetable 10 that is being produced.

The process for producing the second embodiment of the artificial fruit and vegetable structure 10 utilizes a blow mold 162 as shown in FIG. 18. The blow mold has a cavity 164 having a textured surface 166 and an upper surface 168 having therethrough a stem/fill bore 170 that extends into the cavity 164. The process comprises the following steps:

(1) use a blow mold to produce an enclosure 124 having an inner cavity 126, an upper end 128 and an outer surface 130 having a centrally located stem/fill port 134 as shown in FIG. 17. the outer surface 130 has a texture, that is formed by the textured surface 166 of the mold cavity 164 as shown in FIG. 18. The texture is designed to simulate the skin texture of a particular species of a fruit or vegetable 10, (2) remove the enclosure 124 from the mold 168, (3) insert a fluid 142 into the cavity 126 through the stem/fill port 134 as shown in FIG. 17 the inner cavity 126 is substantially filled, (4) seal the stem/fill bore 134 by inserting the lower end 150 of the semi-rigid stem 146 into the bore 134 and thereafter place an adhesive 154 around the interfacing area as shown in FIG. 17, and (5) apply a color 156 to the textured outer surface 136 of the enclosure 124 and the stem 146 as also shown in FIG. 17. The color 156 is selected to simulate the color of the particular species of fruit or vegetable that is being produced.

While the invention has been described in complete detail and pictorially shown in the accompanying drawings, it is not to be limited to such details, since many changes and modifications may be made to the invention without departing from the spirit and the scope thereof. Hence, it is described to cover any and all modifications and forms which may come within the language and scope of the claims.

We claim:

1. A simulated fruit or vegetable structure comprising:

a) an inner assembly comprising:

(1) a solid core having an upper surface and a lower surface, (2) a semi-rigid stem having an upper end and a lower end, wherein the lower end is attached by an attachment means to the upper surface of said core, b) a semi-rigid enclosure having an outer surface comprised of a resilient material and an inner cavity, with the outer surface having therethrough a centrally located stem bore, wherein said core is substantially centered within the cavity with said stem projecting upward through the stem bore and held therein by a stem stop, wherein said core has a weight that is greater than the weight of said semi-rigid enclosure, and c) an outer layer of resilient material that completely covers the outer surface of said semi-rigid enclosure and the area around said stem stop of said stem, wherein said outer layer material and said stem simulate the shape, color and texture of said artificial fruit or vegetable.

* * * * *